US009602945B2

(12) United States Patent
Tsukagoshi

(10) Patent No.: US 9,602,945 B2
(45) Date of Patent: Mar. 21, 2017

(54) APPARATUS, METHOD, AND PROGRAM FOR INFORMATION PROCESSING

(75) Inventor: Ikuo Tsukagoshi, Tokyo (JP)

(73) Assignee: Saturn Licensing LLC., New York, NY (US)

( * ) Notice: Subject to any disclaimer, the term of this patent is extended or adjusted under 35 U.S.C. 154(b) by 716 days.

(21) Appl. No.: 12/683,593

(22) Filed: Jan. 7, 2010

(65) Prior Publication Data

US 2010/0219966 A1 Sep. 2, 2010

(30) Foreign Application Priority Data

Feb. 27, 2009 (JP) ..... 2009-045283

(51) Int. Cl.
*G08B 21/00* (2006.01)
*H04S 7/00* (2006.01)

(52) U.S. Cl.
CPC ..... *H04S 7/303* (2013.01)

(58) Field of Classification Search
CPC ..... H04S 7/303
USPC ..... 340/686.1
See application file for complete search history.

(56) References Cited

U.S. PATENT DOCUMENTS 5,440,639 A * 8/1995 Suzuki ..... H04S 1/002 381/17
6,697,644 B2 * 2/2004 Scherzer ..... H04W 24/02 455/446
7,617,513 B2 * 11/2009 McCafferty ..... H04N 7/106 725/153
2002/0175924 A1 * 11/2002 Yui ..... G06F 3/14 345/660
2004/0227854 A1 * 11/2004 Withers ..... H04N 7/08 348/486
2005/0163329 A1 * 7/2005 Dickey ..... H04S 1/002 381/77
2006/0050892 A1 * 3/2006 Song ..... H04S 7/301 381/59
2006/0109112 A1 * 5/2006 Haines ..... G01S 5/12 340/539.32
2006/0290823 A1 * 12/2006 Kondo ..... H04N 5/4403 348/734
2007/0116306 A1 5/2007 Riedel et al.
(Continued)

FOREIGN PATENT DOCUMENTS

JP 2006-108855 4/2006
JP 2006-229738 8/2006
(Continued)

OTHER PUBLICATIONS

Office Action issued Feb. 10, 2011, in Japan Patent Application No. 2009-045283.

*Primary Examiner* — Naomi Small
(74) *Attorney, Agent, or Firm* — Oblon, McClelland, Maier & Neustadt, L.L.P.

(57) ABSTRACT

An information processing apparatus includes: position detection means for detecting a position of a client unit held by a user on the basis of a signal outputted from the client unit; conversion means for variably setting a parameter value used to convert at least one of a sound signal and a video signal on the basis of the position of the client unit detected by the position detection means and converting the signal using the parameter value; and output means for outputting the signal after conversion by the conversion means.

11 Claims, 6 Drawing Sheets

(56) References Cited

U.S. PATENT DOCUMENTS

| | | | | |
|---|---|---|---|---|
| 2007/0266395 | A1* | 11/2007 | Lee | H04H 60/31<br>725/11 |
| 2009/0051542 | A1* | 2/2009 | Jung | G06F 3/011<br>340/573.1 |
| 2009/0094375 | A1* | 4/2009 | Lection | G06F 15/16<br>709/231 |
| 2010/0013855 | A1* | 1/2010 | Allen | G09G 5/00<br>345/619 |
| 2010/0226499 | A1* | 9/2010 | De Bruijn | H04R 1/403<br>381/17 |

FOREIGN PATENT DOCUMENTS

| | | |
|---|---|---|
| JP | 2006-270522 | 10/2006 |
| JP | 2007-514350 | 5/2007 |
| JP | 2008-160240 | 7/2008 |

* cited by examiner

FIG.4

CLIENT POSITION INFORMATION

| EXAMPLE | SPEAKER 3 | SPEAKER 4 | SPEAKER 5 | SPEAKER 6 | SPEAKER 7 |
|---|---|---|---|---|---|
| INITIAL SETTING | Mid | Mid | Mid | Mid | Mid |
| No1 | Near | Far | Far | Mid | Near |
| No2 | Mid | Far | Far | Near | Near |
| No3 | Far | Far | Near | Near | Mid |
| No4 | Mid | Near | Mid | Far | Far |
| No5 | Near | Far | Near | Near | Near |

APPARATUS, METHOD, AND PROGRAM FOR INFORMATION PROCESSING

BACKGROUND OF THE INVENTION

1. Field of the Invention

The present invention relates to an apparatus, a method, and a medium storing a program for information processing, and more particularly, to an apparatus, a method and a medium storing a program for information processing configured to enable a viewer to view and listen to suitable video and sound independently of the position at which the viewer is present.

2. Description of the Related Art

In the related art, in order to output a video and a sound over a wide range, such as an event site, a super large screen monitor and multi-channel speakers are installed in some cases. In such a case, a multi-channel sound signal is converted to a sound signal of relatively small channels, such as a 2 channel sound signal and a 5.1 channel sound signal. Sounds corresponding to sound signals of the respective channels are outputted from the speakers of the corresponding channels. This configuration is described, for example, in JP-A-2006-108855.

SUMMARY OF THE INVENTION

In a wide range, such as an event site, however, there is a case where a viewer is not able to view and listen to suitable video and sound depending on the position at which the viewer is present.

Thus, it is desirable to enable a viewer to view and listen to suitable video and sound independently of the position at which the viewer is present.

According to an embodiment of the present invention, there is provided an information processing apparatus including position detection means for detecting a position of a client unit held by a user on the basis of a signal outputted from the client unit, conversion means for variably setting a parameter value used to convert at least one of a sound signal and a video signal on the basis of the position of the client unit detected by the position detection means and converting the signal using the parameter value, and output means for outputting the signal after conversion by the conversion means.

The conversion means may variably set a parameter value used to determine a mixing ratio of a multi-channel sound signal and convert the sound signal using the parameter value.

Of a plurality of divided regions obtained by dividing a predetermined region, the position detection means may detect information specifying a divided region in which the client unit is positioned, and the conversion means may variably set the parameter value on the basis of the information detected by the position detection means.

The conversion means may variably set a parameter value used to determine an enlargement ratio of one of a video corresponding to the video signal and a character relating to the video and convert the video signal using the parameter value.

The position detection means may detect the position of the client unit as a time variable on the basis of temporal transition of a signal outputted from the client unit.

The conversion means may maintain setting of the parameter value in a case where the position detection means detects that the position of the client unit has not been changed.

According to another embodiments of the present invention, there are provided a method and a medium storing a program for information processing corresponding to the image processing apparatus configured as above.

With the apparatus, the method, and the medium storing a program for information processing according to the embodiments of the present invention, an information processing apparatus that outputs at least one of a sound signal and a video signal as an output signal or a computer that controls an output device that outputs at least one of a sound signal and a video signal as an output signal detects the position of a client unit held by the user on the basis of a signal outputted from the client unit, and variably sets a parameter value used to convert an original signal from which the output signal is generated on the basis of the detected position of the client unit to convert the signal using the parameter value, so that the signal after conversion is outputted as the output signal.

As has been described, according to the embodiments of the present invention, the viewer is enabled to view and listen to suitable video and sound independently of the position at which the viewer is present.

BRIEF DESCRIPTION OF THE DRAWINGS

FIG. 4 is a view used to describe the sound signal output processing in the sound signal output device to which the present invention is applied;

DESCRIPTION OF THE PREFERRED EMBODIMENTS

Hereinafter, examples of an information processing system to which the present invention is applied will be described as a first embodiment and a second embodiment in the following order.

1. First embodiment (an example where a client unit CU is formed of a wireless tag alone)

2. Second embodiment (an example where a client unit CU is formed of a headphone with wireless tag and a monitor with wireless tag).

<1. First Embodiment>

[Example of Configuration of Information Processing System to Which Present Invention is Applied]

Figure 1:
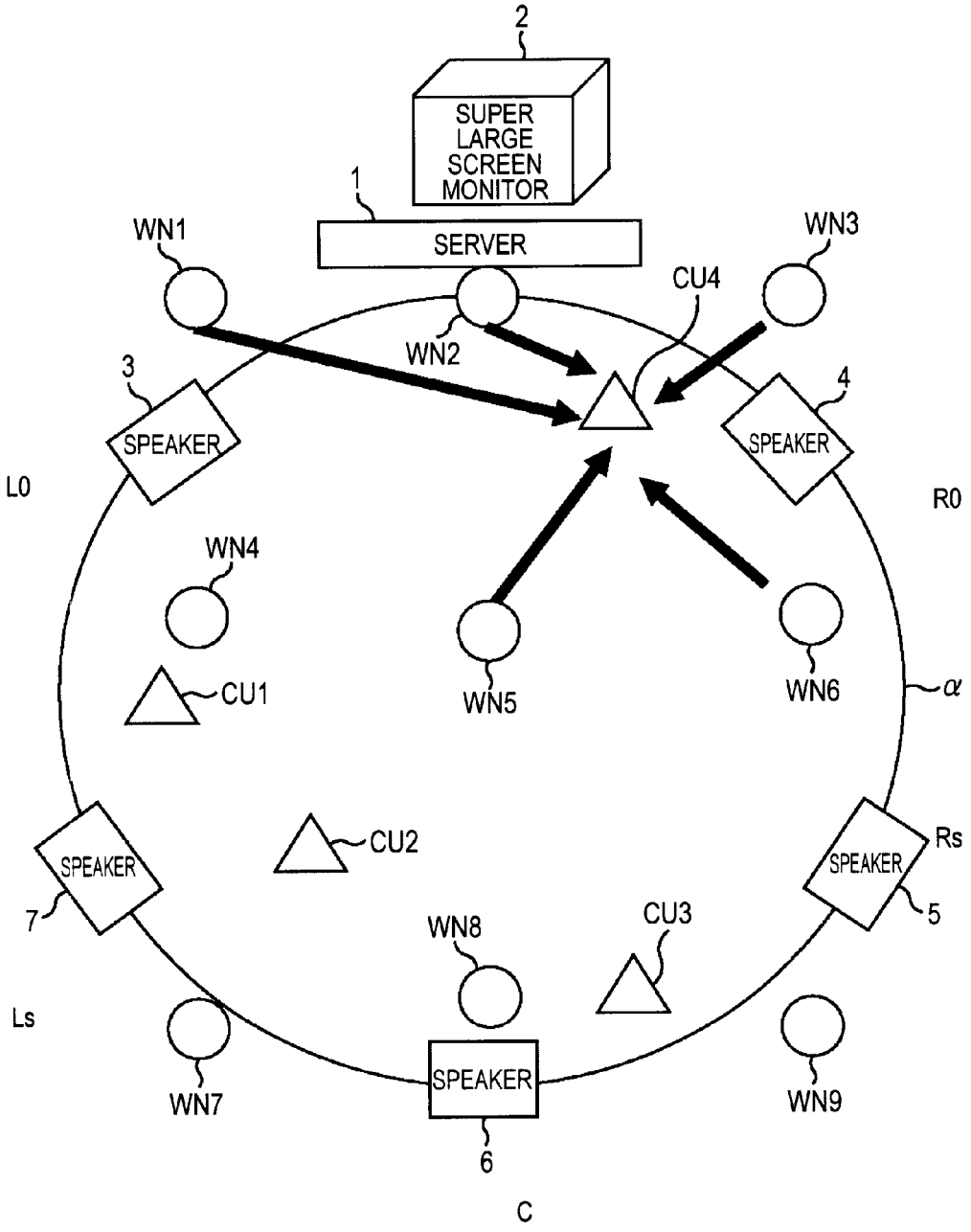
FIG. 1 is view showing an example of the configuration of an information processing system to which the present invention is applied.

FIG. 1 is a view showing an example of the configuration of an information processing system to which the present invention is applied.

The information processing system includes a server 1, a super large screen monitor 2, speakers 3 through 7, wireless nodes WN1 through WNK (K is an integer value of 1 or larger and K=9 in the example of FIG. 1), and client units CU1 through CUM (M is an integer value representing the number of users and M=4 in the case of FIG. 1).

The information processing system is constructed in a wide region, such as an event site.

In the example of FIG. 1, the server 1 and the super large screen monitor 2 are installed on the upper side of FIG. 1. Hereinafter, the upward direction in FIG. 1, that is, a direction in which the user views the super large screen monitor 2 is referred to as the front direction. Also, the downward direction in FIG. 1 is referred to as the rear direction, the leftward direction in FIG. 1 is referred to as the left direction, and the rightward direction in FIG. 1 is referred to as the right direction. It goes without saying, however, that the installed position of the server 1 is not limited to the position specified in the example of FIG. 1 and the server 1 can be installed at an arbitrary position.

For example, assume that a circular region a formed oppositely to the front face of the super large screen monitor 2 (the display surface of the super large screen monitor 2) represents a region within which the user is able to view a video displayed on the super large screen monitor 2. Hereinafter, the region α is referred to as the target region. It should be appreciated that the target region α is a design matter that can be determined freely by the constructor of the information processing system and, as a matter of course, the target region α is not necessarily designed as is shown in FIG. 1. The speakers 3 through 7 are installed on the boundary (circumference) of the target region α. To be more concrete, the speaker 3 is installed oppositely to the super large screen monitor 2 at the front left, the speaker 4 at the front right, the speaker 5 at the rear right, the speaker 6 at the rear center, and the speaker 7 at the rear left.

The wireless nodes WN1 through WN9 are installed from front to rear at regular intervals vertically in three lines and horizontally in three lines.

It is sufficient that a plurality of the wireless nodes out of the wireless nodes WN1 through WN9 are installed within the target region α and the installment positions and the number of the wireless nodes are not limited to those specified in FIG. 1.

The client units CUK (K is an integer value from 1 to M, where M is the maximum number of the viewers) are held by respective unillustrated users. For example, in the example shown in FIG. 1, M=4. More specifically, in the example of FIG. 1, the client units CU1 through CU4 are held by four viewers, one by each viewer. As will be described below, in a case where the client unit CUK is positioned within the target region α, the server 1 detects the position thereof. The detection position specifies the position at which the user who holds the client unit CUK is present.

The server 1 outputs a video signal inputted therein to the super large screen monitor 2. The super large screen monitor 2 displays a video corresponding to this video signal. The viewer present within the target region α views the video being displayed on the super large screen monitor 2.

Also, a multi-channel sound signal is inputted into the server 1. According to the first embodiment, the server 1 converts a multi-channel sound signal inputted therein to a 5.1 channel sound signal. Herein, the 5.1 channel sound signal is made up of a stereo signal L0, a stereo signal R0, a right surround signal Rs, a center channel signal C, and a left surround signal Ls.

In the initial state, a 5.1 channel sound signal is supplied as follows. That is, the stereo signal L0 is supplied to the speaker 3, the stereo signal R0 to the speaker 4, the right surround signal Rs to the speaker 5, the center channel signal C to the speaker 6, and the left surround signal Ls to the speaker 7.

In other words, in the initial state, a sound corresponding to the stereo signal L0 is outputted from the speaker 3 and a sound corresponding to the stereo signal R0 is outputted from the speaker 4. A sound corresponding to the right surround signal Rs is outputted from the speaker 5, a sound corresponding to the center channel signal C is outputted from the speaker 6, and a sound corresponding to the left surround signal Ls is outputted from the speaker 7.

In this manner, in the initial state, merely a traditional 5.1 channel sound is outputted from the speakers 3 through 7. Accordingly, in a case where a viewer is present at the best listening point near the center of the target region α, the viewer is able to listen to the best sound. The term, "best", in the phrase, "the best listening point", referred to herein means the best in a case where merely a traditional 5.1 channel sound is outputted. More specifically, as will be described below, it should be noted that any point within the target region α is the best listening point in a case where the present invention is applied. In view of the foregoing, hereinafter, the best listening point in a case where merely a traditional 5.1 channel sound is outputted is referred to as the traditional best listening point.

Incidentally, because the target region α is a wide region, such as an event site, the viewer is not necessarily positioned at the traditional best listening point. Hence, in a case where the viewer is not positioned at the traditional best listening point, as has been described in the summary column above, the viewer is not able to listen to a suitable sound.

In order to overcome this inconvenience, according to the first embodiment, the server 1 performs control to change the states of respective sounds outputted from the speakers 3 through 7 in response to the position at which the viewer is present. More specifically, in a case where the viewer is present at a position other than the traditional best listening point, the server 1 performs the control to cause transition of the states of respective sounds outputted from the speakers 3 through 7 to states different from the initial state. In order to achieve this control, it is necessary for the server 1 to first detect the position at which the viewer is present. The server 1 is therefore furnished with a function of detecting the position of the client unit CUK, that is, a function of detecting the position at which the viewer who holds the client unit CUK is present. Hereinafter, this function is referred to as the client unit position detection function. Also, information indicating the detection result of the client unit CUK is referred to as the client unit position information.

In order to achieve the client unit position detection function, each of the client units CU1 through CU4 has a wireless tag. The respective wireless tags of the client units CU1 through CU4 transmit signals.

Hereinafter, in a case where it is not necessary to distinguish the client units CU1 through CU4 from one another, each is referred to generally as the client unit CU and a signal transmitted from the client unit CU is referred to as the client unit signal.

Each of the wireless nodes WN1 through WN9 receives the client unit signal. Each of the wireless nodes WN1 through WN9 measures the radio field strength and the delay characteristics of the client unit signal. Hereinafter, the measurement result is referred to as the client signal measurement result. The client signal measurement result is outputted to the server 1.

The server 1 generates the client unit position information according to the respective client signal measurement results from the wireless nodes WN1 through WN9. In other words, the position at which the user who holds the client unit CU is present is detected. The server 1 then performs the control to change the states of the respective sounds to be outputted from the speakers 3 through 7 in response to the position at which the user is present. An example of this control will be described in detail below. Also, hereinafter, in a case where it is not necessary to distinguish the wireless nodes WN1 through WN9 from one another, each is generally referred to as the wireless node WN.

Figure 2:
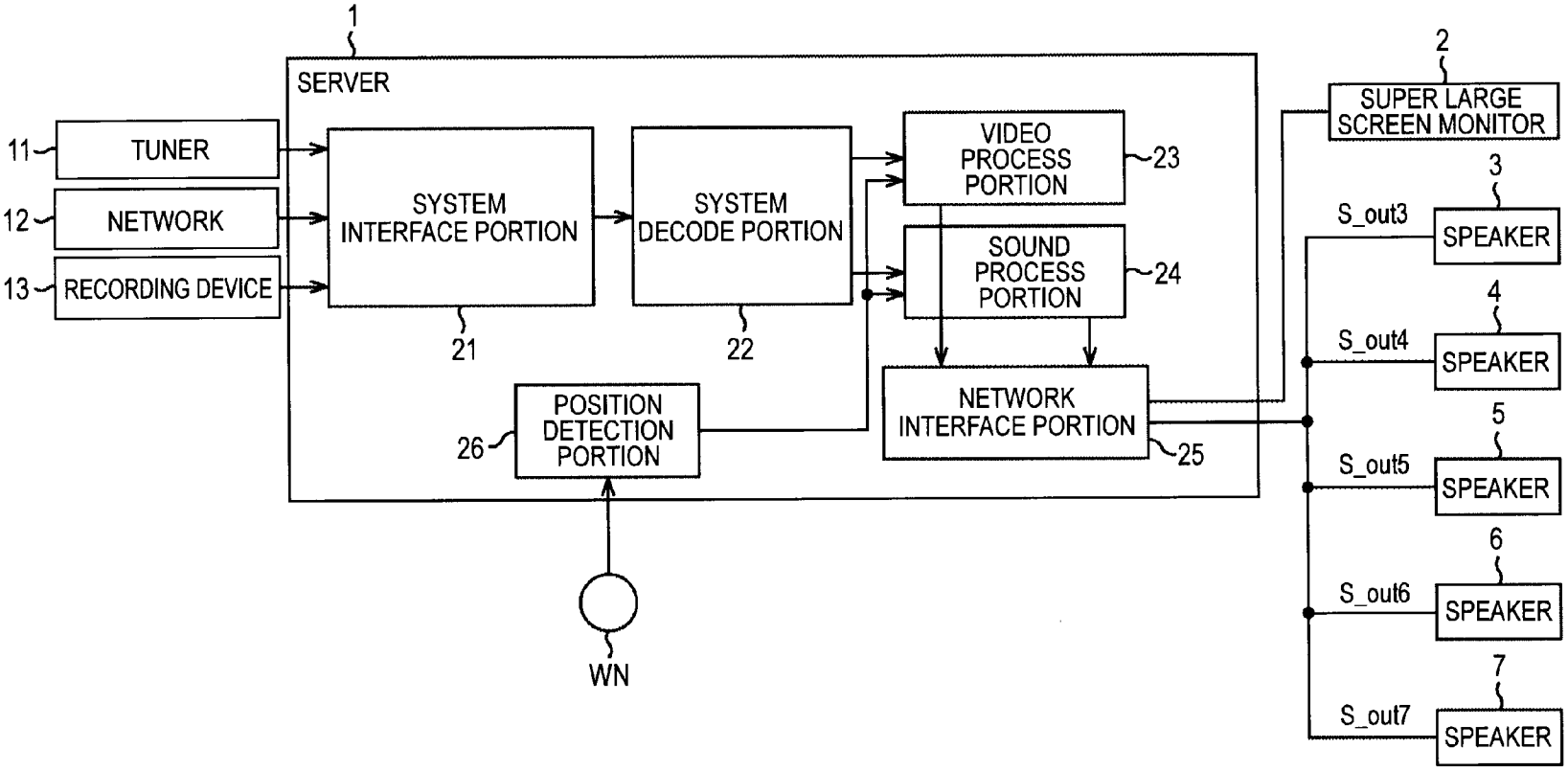
FIG. 2 is a block diagram showing the configuration of an embodiment of the information processing system to which the present invention is applied.

FIG. 2 is a block diagram of an example of the detailed configuration of the server 1.

The server 1 includes a system interface portion 21, a system decode portion 22, a video process portion 23, a sound process portion 24, a network interface portion 25, and a position detection portion 26.

Also, for example, a tuner 11, a network 12, and a recording device 13 are connected to the server 1. The tuner 11, the network 12, and the recording device 13 may be understood as the components forming the information processing system of FIG. 1. Further, the server 1 may be furnished with the respective functions of the tuner 11 and the recording device 13.

The tuner 11 receives a broadcast program from the broadcast station and supplies the system interface portion 21 with the broadcast program in the form of compression coded video signal and sound signal.

A video signal and a sound signal compression coded by another device are outputted from this device and supplied to the system interface portion 21 via the network 12.

The recording device 13 records contents in the form of compression coded video signal and sound signal. The recording device 13 supplies the system interface portion 21 with contents in the form of the compression coded video signal and sound signal.

The system interface portion 21 supplies the system decode portion 22 with the video signal and the sound signal supplied from the tuner 11, the network 12 or the recording device 13.

As has been described, the video signal and the sound signal supplied to the system decode portion 22 from the system interface portion 21 are compression coded in a predetermined format. The system decode portion 22 therefore applies decompression decode processing to the compression coded videos signal and sound signal. Of the video signal and the sound signal obtained as a result of the decompression decode processing, the video signal is supplied to the video process portion 23 and the sound signal is supplied to the sound process portion 24.

The video process portion 23 applies image processing properly to the video signal from the system decode portion 22 and then supplies the network interface portion 25 with the resulting video signal.

As has been described, the sound signal supplied to the sound process portion 24 is a multi-channel sound signal. The sound process portion 24 therefore converts the multi-channel sound signal to a 5.1 channel sound signal. Further, the sound process portion 24 generates sound signals of the respective channels to be supplied to the speakers 3 through 7 using the client unit position information from the position detection portion 26 and the 5.1 channel sound signal. Hereinafter, sound signals of the respective channels to be supplied to the speakers 3 through 7 are referred to as the sound signal S_out3, the sound signal S_out4, the sound signal S_out5, the sound signal S_out6, and the sound signal S_out7, respectively. A series of processing operations until the sound signals S_out3 through S_out7 are generated is referred to as the sound signal output processing. The sound signal output processing will be described in detail below using FIG. 3.

The network interface portion 25 outputs the video signal from the video process portion 23 to the super large screen monitor 2. Also, the network interface portion 25 outputs the sound signals S_out3 through S_out7 from the sound process portion 24 to the speakers 3 through 7, respectively.

The position detection portion 26 receives the client signal measurement result of the wireless node WN and generates the client unit position information on the basis of the received result. The term, "the client unit position information", referred to herein means, as described above, information specifying the position at which the user who holds the client unit CU is present. The client unit position information is provided to the sound process portion 24 from the position detection portion 26.

[Example of Processing Method of Sound Signal Output Device To which Present Invention is Applied]

Figure 3:
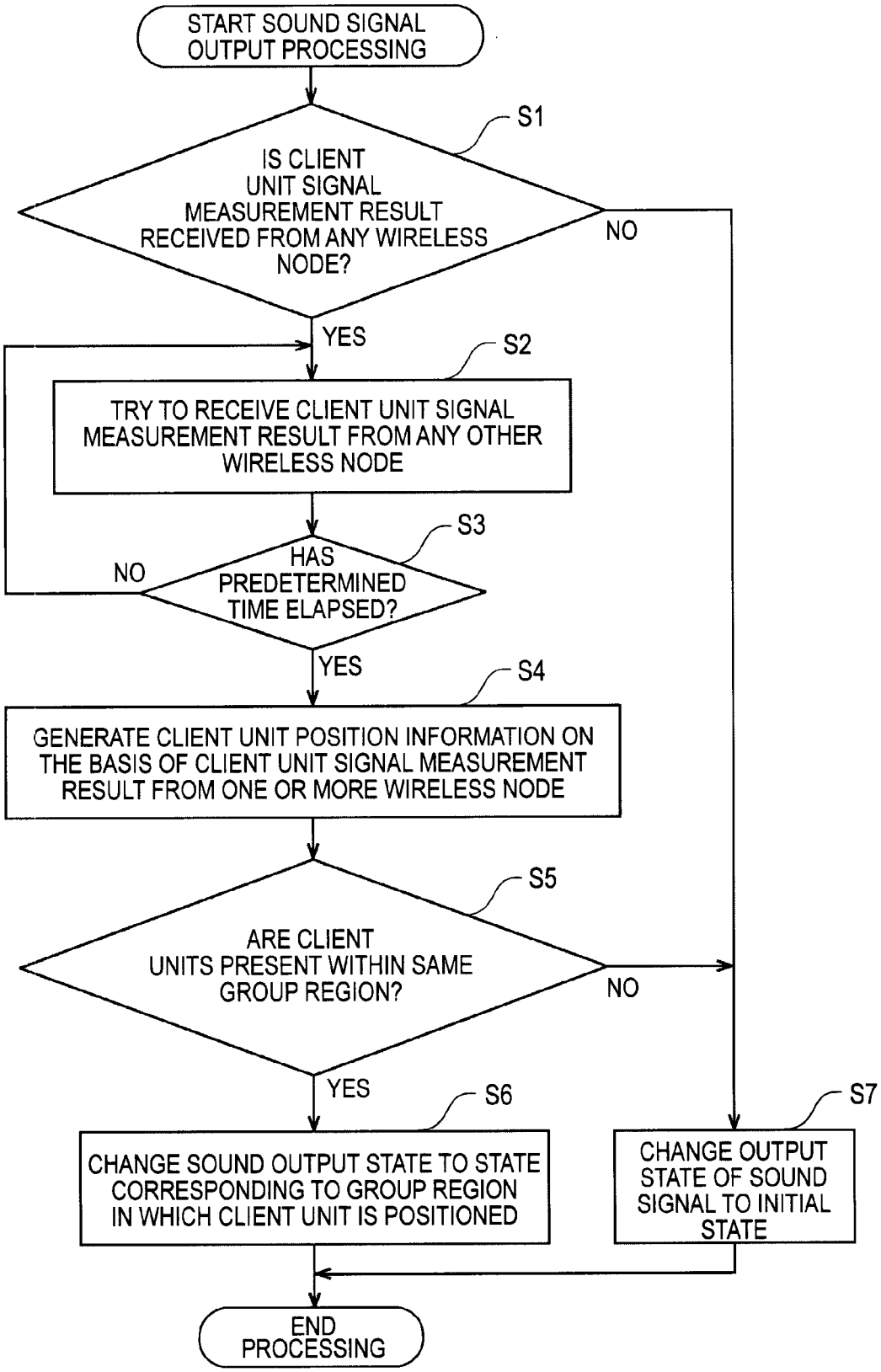
FIG. 3 is a flowchart used to describe sound signal output processing in a sound signal output device to which the present invention is applied.

FIG. 3 is a flowchart used to describe an example of the sound signal output processing.

In Step S1, the position detection portion 26 of the server 1 determines whether the client unit signal measurement result is received from any one of the wireless nodes WN.

In the example of FIG. 1, a case where the client unit signal measurement result is not received from any of the wireless nodes WN1 through WN9 means a case where there is no client unit CU within the target region α. Hence, in such a case, the determination result in Step S1 is NO and the flow proceeds to the processing in Step S7. The processing in Step S7 and the subsequent processing will be described below.

On the contrary, in a case where the client unit signal measurement result is transmitted from at least one of the wireless nodes WN1 through WN9 and received by the position detection portion 26, the determination result in Step S1 is YES and the flow proceeds to the processing in Step S2.

In Step S2, the position detection portion 26 tries to receive the client unit signal measurement result from any other wireless node WN.

In Step S3, the position detection portion 26 determines whether a predetermined time has elapsed. In a case where the predetermined time has not elapsed, the determination result in Step S3 is NO and the flow returns to the processing in Step S2 and the processing thereafter is repeated. In other words, each time the client unit signal measurement result is transmitted from any other wireless node WN, the client unit signal measurement result is received by the position detection portion 26 until the predetermined time elapses.

When the predetermined time has elapsed, the determination result in Step S3 is YES and the flow proceeds to the processing in Step S4.

In Step S4, the server 1 generates the client unit position information on the basis of the client unit signal measurement result from one or more wireless node WN. The client unit position information is supplied from the position detection portion 26 to the sound process portion 24.

To be more concrete, according to the first embodiment, for example, the target region α is divided to a plurality of regions (hereinafter, referred to as the group regions). The position detection portion 26 detects which client unit CU is positioned in which group region on the basis of the client unit signal measurement result received from the wireless node WN. The position detection portion 26 then generates information specifying the group region to which the client unit CU belongs as the client unit position information. A concrete example of the client unit position information will be described below using FIG. 4.

Also, it should be appreciated that the client unit CU is not limited to one and there can be as many client units CU as the viewers who are present within the target region α. For example, in the example of FIG. 1, there are four client units all through CU4 within the target region α. In this case, the client unit position information is generated for each of a plurality of client units CU by the processing in Step S4.

In Step S5, the sound process portion 24 determines whether the client units CU to be detected are positioned within the same group region.

The phrase, "the client units CU to be detected", referred to herein means the client units CU for which the client unit position information is generated by the processing in Step S4.

In a case where at least one of a plurality of the client units CU is present in a different group region within the target: region α, the determination result in Step S5 is NO and the flow proceeds to the processing in Step S7. The processing in Step S7 and the subsequent processing will be described below.

On the contrary, in a case where only one client unit CU is present within the target region a or a plurality of the client units CU are present within the same group region, the determination result in Step S5 is YES and the flow proceeds to the processing in Step 6.

In Step S6, the sound process portion 24 changes an output state of a sound signal to a state corresponding to the group region in which the client unit CU is positioned. More specifically, the sound process portion 24 generates the respective sound signals S_out3 through S_out7 corresponding to the group region and outputs these sound signals to the respective speakers 3 through 7 via the network interface portion 25.

On the contrary, in a case where no client unit CU is present within the target region α or a plurality of client units CU are present in two or more group regions, the determination result in Step S1 or Step S5 is NO and the flow proceeds to the processing in Step S7. In Step S7, the sound process portion 24 changes an output state of the sound signal to the initial state. More specifically, the sound process portion 24 outputs the stereo signal L0, the stereo signal R0, the right surround signal Rs, the center channel signal C, and the left surround signal Ls to the speakers 3 through 7, respectively, via the network interface portion 25.

In a case where a plurality of the client units CU are present in two or more group regions, that is, in a case where the determination result in Step S5 is NO, the sound process portion 24 may also change an output state of the sound signal to a state different from the initial state, for example, a state where there is no directivity.

It should be noted that the sound signal output processing is repeated at regular time intervals. More specifically, the client unit signal measurement results from a plurality of the wireless nodes WN installed at many points are transmitted to the position detection portion 26 of the server 1 at regular time intervals. In a case where it turns out that the client units CU have not moved, the output state of the sound signal after the processing in Step S6 is the same in each processing. More specifically, in a case where the client unit CU has not moved, the output state of the sound signal is maintained. On the contrary, in a case where the client unit CU has moved, an output state of the sound signal after the processing in Step S6 varies from time to time in each processing in response to the moved position of the client unit CU. In this case, the position detection portion 26 is able to calculate each piece of the client unit position information as a time variable and construct a center offset distance table on the basis of the calculation result.

FIG. 4 is a view showing an example of the client unit position information.

The client unit position information shown in FIG. 4 is indicated by a combination of distances between the client unit CU of interest and the respective speakers 3 through 7.

The first row (initial setting) of FIG. 4 shows a basic example of the client unit position information in a case where an output state is the initial state. In a case where such client unit position information (initial setting) is supplied to the sound process portion 24 from the position detection portion 26, the output state of the sound signal transitions to the initial state. More specifically, the stereo signal L0, the stereo signal R0, the right surround signal Rs, the center channel signal C, and the left surround signal Ls are outputted from the speakers 3 through 7, respectively.

For example, assume that the client unit CU1 of FIG. 1 alone is present within the target region α. In this case, the client unit CU1 belongs to a group region that is near (Near) the speaker 3, far (Far) from the speaker 4, far (Far) from the speaker 5, middle (Mid) with respect to the speaker 6, and near (Near) the speaker 7. Accordingly, the client unit position information No1 shown in FIG. 4 is generated by the position detection portion 26 and supplied to the sound process portion 24.

In this case, the sound process portion 24 computes Equation (1) through Equation (5) below to generate the respective sound signals S_out3 through S_out7 and outputs these sound signals to the respective speakers 3 through 7 via the network interface portion 25.

$$\text{Speaker 3}: S_out3 = L0*CL + R0*CS + C*CS + Rs*CS + Ls*CM \quad (1)$$

$$\text{Speaker 4}: S_out4 = L0*CL + R0*CL + C*CS + Rs*CM + Ls*CS \quad (2)$$

$$\text{Speaker 5}: S_out5 = L0*CL + R0*CL + C*CS + Rs*CM + Ls*CS \quad (3)$$

$$\text{Speaker 6}: S_out6 = L0*CL + R0*CL + C*CS + Rs*CM + Ls*CS \quad (4)$$

$$\text{Speaker 7}: S_out7 = L0*CS + R0*CL + C*CS + Rs*CM + Ls*CS \quad (5)$$

Herein, CL, CM, and CS are coefficients (hereinafter, referred to as the down mix coefficients) to assign weights to the sound signal. The down mix coefficients CS, CM, and CL are in order of decreasing values.

That is to say, a sound signal S_outM (M is an integer value from 3 to 7) supplied to a speaker M is calculated in accordance with Equation (6) below. More specifically, the stereo signal L0, the stereo signal R0, the right surround signal Rs, the center channel signal C, and the left surround signal Ls are multiplied by the down mix coefficients C1 through C5, respectively, and a linear combination of all the resulting weighted channel signals is the sound signal S_outM.

$$\text{Speaker } M: S_outM = L0*C1 + R0*C2 + C*C3 + Rs*C4 + Ls*C5 \quad (6)$$

Each of the down mix coefficients C1 through C5 can be changed to any one of the down mix coefficients CL, CM, and CS according to the group region in which the client unit M is present.

For example, assume that a combination of the down mix coefficients C1 through C5 is determined in advance for the respective speakers 3 through 7 according to the group region specified by the client unit position information No2. In this case, when the client unit CU2 of FIG. 1 alone is present within the target region α, the client unit position information No2 is obtained. Hence, the combination of the down mix coefficients C1 through C5 determined in advance for the client unit position information No2 is adopted for the respective speakers 3 through 7. Then, Equation (6) above is computed by substituting the adopted down mix coefficients C1 through C5 for the respective speakers 3 through 7. The respective sound signals S_out3 through S_out7 corresponding to the client unit position information No2 are thus generated.

Also, for example, assume that a combination of the down mix coefficients C1 through C5 is determined in advance for the respective speakers 3 through 7 according to the group region specified by the client unit position information No3. In this case, when the client unit CU3 of FIG. 1 alone is present within the target region α, the client unit position information No3 is obtained. Hence, the combination of the down mix coefficients C1 through C5 determined in advance for the client unit position information No3 is adopted for the respective speakers 3 through 7. Then, Equation (6) above is computed by substituting the adopted down mix coefficients C1 through C5 for the respective speakers 3 through 7. The sound signals S_out3 through S_out7 corresponding to the client unit position information No3 are thus generated.

Also, for example, assume that a combination of the down mix coefficients C1 through C5 is determined in advance for the respective speakers 3 through 7 according to the group region specified by the client unit position information No4. In this case, when the client unit CU4 of FIG. 1 alone is present within the target region α, the client unit position information No4 is obtained. Hence, the combination of the down mix coefficients C1 through C5 determined in advance for the client unit position information No4 is adopted for the respective speakers 3 through 7. Then, Equation (6) above is computed by substituting the adopted down mix coefficients C1 through C5 for the respective speakers 3 through 7. The respective sound signals S_out3 through S_out7 corresponding to the client unit position information No4 are thus generated.

By the sound signal output processing as above, no matter where in the target region α the viewer who holds the client unit CU is present, the respective sound signals S_out3 through S_out7 generated suitably to the position at which the viewer is present are supplied to the speakers 3 through 7, respectively. Hence, sounds of the respective channels suitable to the position at which the viewer is present are outputted from the respective speakers 3 through 7. This configuration thus enables the viewer to listen to suitable sounds.

The sound signal processing in a case where the client unit position information No5 of FIG. 4 is obtained will now be described.

The client unit position information No5 is a collective of information that the group region of interest is near (Near) the speaker 3, far (Far) from the speaker 4, near (Near) the speaker 5, near (Near) the speaker 6, and near (Near) the speaker 7.

In the example of FIG. 1, however, it is unthinkable that the client unit position information No5 is obtained while any one of the client units CU1 through CU4 alone remains stationary. Hence, in the example of FIG. 1, there are two possibilities when the client unit position information No5 is obtained.

A first possibility is that a plurality of client units CU are present in different group regions. For instance, in the example of FIG. 1, in a case where the client unit CU1 and the client unit CU3 are present at the positions specified in FIG. 1 at the same time, the client unit position information No5 is obtained.

A second possibility is that a single client unit CU is in motion while the processing to obtain the client unit position information is being carried out. For instance, in the example of FIG. 1, in a case where the client unit CU1 has moved from the position specified in FIG. 1 to the position specified as the position of the client unit CU2 in FIG. 1, the client unit position information No5 is obtained.

In a case where the client unit position information No5 is obtained as above, the sound process portion 24 changes an output: state of the sound signal to a universal state where there is no directivity (for example, the initial state).

In a case where it is necessary to distinguish between the first possibility and the second possibility, the center offset distance table constructed on the basis of the respective pieces of the client unit position information as time variables is used. This is because the first possibility and the second possibility can be readily distinguished from each other by merely reviewing the history of the client unit position information obtained before the client unit position information No5.

As has been described, the server 1 is naturally able to variably set parameters (the down mix coefficients in the example described above) of the sound signal on the basis of the client unit position information of the client unit CU. Further, the server 1 is able to change the various parameters of a video signal on the basis of the client unit position information of the client unit CU. For example, in a case where the position at which the client unit CU is present is far from the position of the super large screen monitor 2, the server 1 is able to set the various parameters so that a video or character information (sub-titles or the like) relating to the video will be displayed in an enlarged scale.

<2. Second Embodiment>

[Example of Configuration of Client Unit CU]

Figure 5:
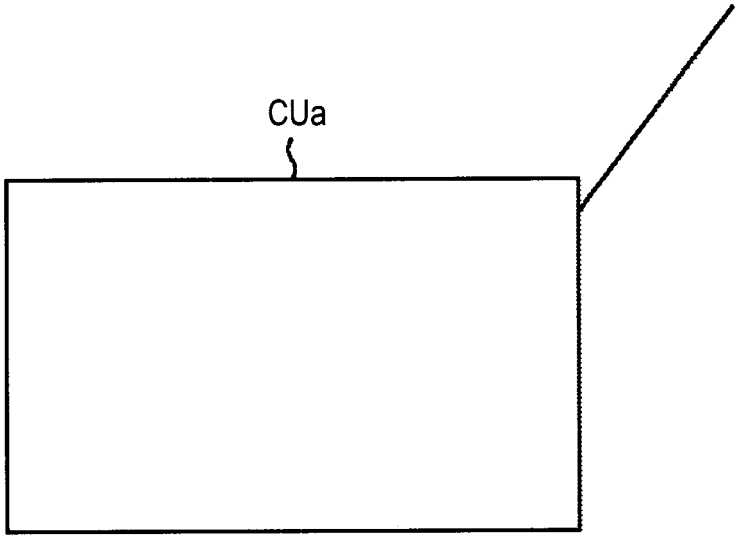
FIG. 5 is a view showing an example of the configuration of a client unit in the sound signal output device to which the present invention is applied.
Figure 5:
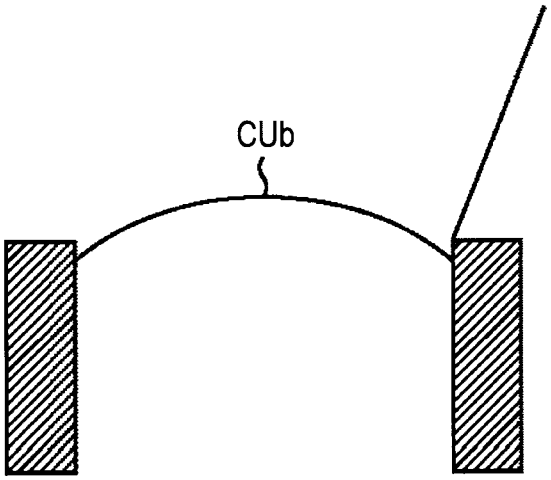

FIG. 5 is an example of the configuration of the client unit CU different from the configuration described above using FIG. 1 and FIG. 2.

A client unit CUa shown in FIG. 5 is a portable monitor with wireless tag. Also, a client unit CUb is a headphone with wireless tag.

The client unit CUa receives a video signal and a sound signal from the server 1 and displays a video corresponding to the video signal and outputs a sound corresponding to the sound signal.

In this case, the server 1 is naturally able to variably set parameters (for example, the down mix coefficients) of the sound signal described above on the basis of the client unit position information of the client unit CUa. Further, the server 1 is able to change the various parameters of the video signal on the basis of the client unit position information of the client unit CUa. For example, the server 1 is able to set the various parameters in response to the position at which the client unit CUa is present so that a video being displayed on the super large screen monitor 2 or the character information (sub-titles or the like) relating to the video will be displayed to fit the client unit CUa.

The client unit CUb receives a sound signal from the server 1 and outputs the received sound.

For example, the server 1 is able to variably set parameters (for example, the down mix coefficients) of the sound signal described above on the basis of the client unit position information of the client unit CUb. After the parameters are set, the sound signal generated by the server 1, that is, the respective sound signals S_out3 through S_out7 in the example described above, is wirelessly transmitted to the client unit CUb.

More specifically, it is the precondition of the first embodiment above that the sounds of the respective channels are outputted from the respective speakers 3 through 7. Accordingly, in a case where a plurality of the client units CU are present in different group regions, the server 1 makes a universal setting (for example, the setting of parameter values to cause transition to the initial state) with no directivity as the parameters of the sound signals.

On the contrary, in the second embodiment, a sound is outputted from the client unit CUb. Hence, for example, even in a case where a plurality of the client units CUb are present in different group regions, the server 1 is able to make individual settings (for example, setting of different down mix coefficients) corresponding to the respective positions at which the client units CUb are present as parameters of the sound signal. The client unit CUb thus enables the viewer to listen to a sound signal that suits the position at which the viewer is present.

The viewer may hold both or either one of the client unit CUa and the client unit CUb.

It should be appreciated that a method of detecting the client position by the information processing apparatus to which the present invention is applied is not limited to the method described above using FIG. 1 through FIG. 4 and an arbitrary method is also available.

The information processing apparatus to which the present invention is applied is able to output suitable video and sound in response to the position at which the viewer is present. Consequently, in a case where the viewer views and listen to a video and a sound in a wide range, for example, an event site, the viewer becomes able to readily view and listen to suitable video and sound independently of the position at which the viewer is present.

Further, the information processing apparatus to which the present invention is applied is able to calculate respective pieces of the client unit position information as time variables. Consequently, even in a case where the viewer has moved, for example, within an event site, the information processing apparatus to which the present invention is applied is able to arrange the appreciation environment that suits the position at which the viewer is present.

Incidentally, a series of the processing operations described above can be performed by either hardware or software.

Figure 6:
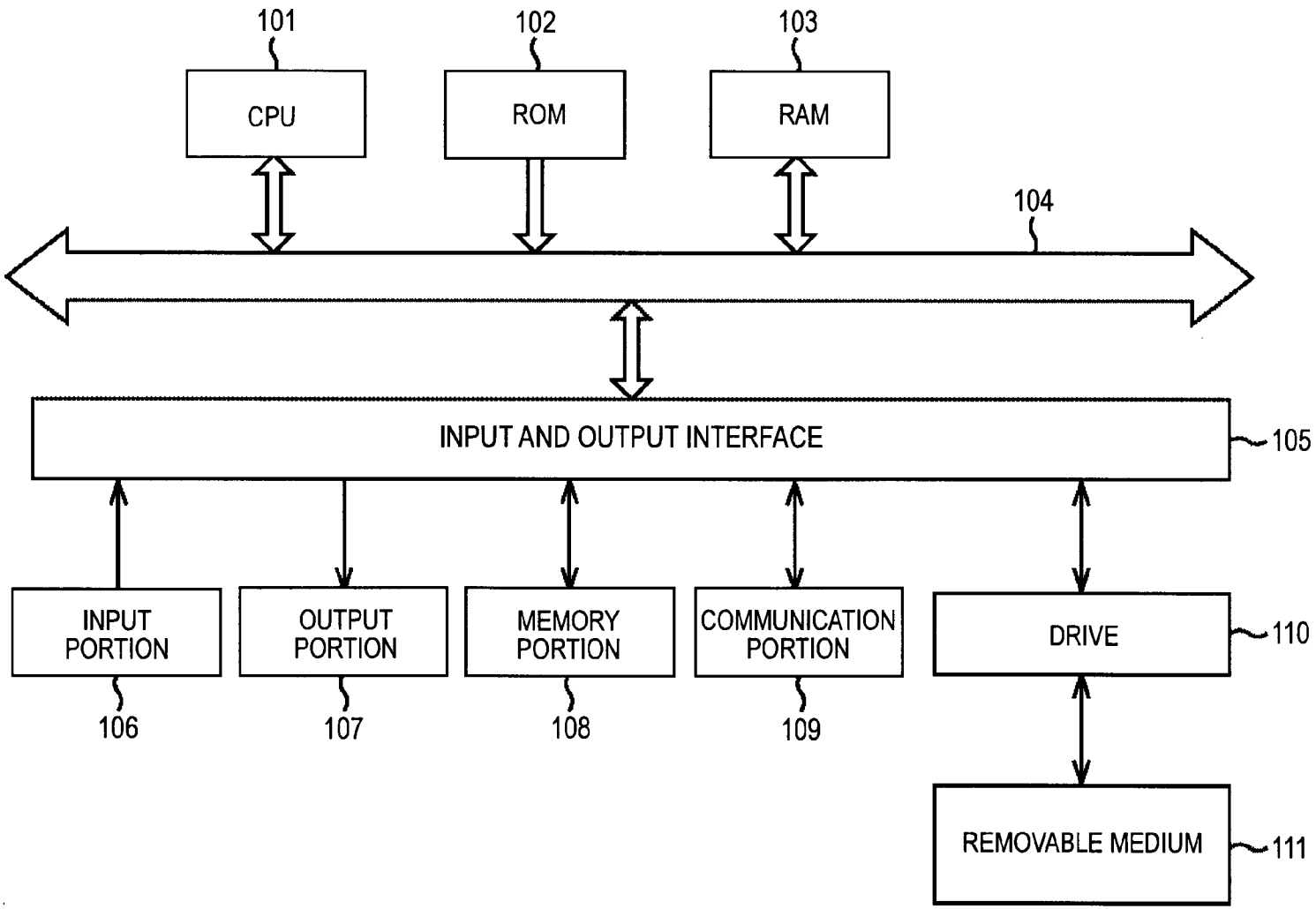
FIG. 6 is a block diagram showing an example of the configuration of a computer that is included in the sound signal control device to which the present invention is applied or controls the driving of the sound signal control device.

In a case where a series of the processing operations is performed by software, the information processing apparatus to which the present invention is applied may include a computer shown in FIG. 6. Alternatively, a robot hand device to which the present invention is applied may be controlled by the computer of FIG. 6.

Referring to FIG. 6, a CPU (Central Processing Unit) 101 performs various types of processing according to a program pre-recoded in a ROM (Read Only Memory) 102 or a program loaded into a RAM (Random Access Memory) 103 from a memory portion 108. Data necessary when the CPU 101 performs various types of processing is also stored appropriately in the RAM 103.

The CPU 101, the ROM 102, and the RAM 103 are interconnected via a bus 104. The bus 104 is also connected to an input and output interface 105.

An input portion 106 formed of a keyboard and a mouse, an output portion 107 formed of a display, a memory portion 108 formed of a hard disk, and a communication portion 109 formed of a modem and a terminal adapter are connected to the input and output interface 105. The communication portion 109 controls communications made with another device (not shown) via a network including the Internet.

A drive 110 is also connected to the input and output interface 105 when the necessity arises. A magnetic disk, an optical disk, a magneto optical disk, or a removable medium 111 formed of a semiconductor memory is loaded appropriately into the drive 110 and a computer program read from the loaded disk or medium is installed into the memory portion 108 when the necessity arises.

In a case where a series of the processing operations is performed by the software, the program constructing the software is installed from a network or a recording medium into a computer incorporated into exclusive-use hardware or, for example, into a general-purpose personal computer that becomes able to perform various functions when various programs are installed therein.

As is shown in FIG. 6, a recording medium including such a program is formed of not only a magnetic disk (including a floppy disk), an optical disk (including a CD-ROM (Compact Disk-Read Only Memory) and a DVD (Digital Versatile Disk)), a magneto optical disk (including an MD (Mini-Disk)), or a removable medium (package medium) 111 formed of a semiconductor memory, each of which pre-records a program and is distributed separately from the apparatus main body so as to provide the program to the viewer, but also the ROM 102 or the hard disk included in the memory portion 108, each of which pre-records a program and provided to the viewer in a state where it is incorporated into the apparatus main body.

It should be appreciated that the steps depicting the program recorded in the recording medium in the present specification include the processing operations performed time sequentially in order as well as the processing operations that are not necessarily performed time sequentially but performed in parallel or separately.

In addition, the term, "system", referred to in the present specification represents an overall apparatus formed of a plurality of devices and processing portions.

The present application contains subject matter related to that disclosed in Japanese Priority Patent Application JP 2009-045283 filed in the Japan Patent Office on Feb. 27, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing apparatus comprising:

circuitry configured to receive a measurement result from one or more wireless nodes that measure a signal output from each of a plurality of client devices;

detect a region in which each of the plurality of client devices is positioned within a target area divided into a plurality of regions, on a basis of the received measurement result, wherein each of the plurality of regions has a set of corresponding parameter values for controlling at least one of a sound signal and a video signal;

determine whether all of the plurality of client device are positioned within a same region;

when the plurality of client devices are positioned within the same region convert the at least one of the sound signal and the video signal using the parameter values corresponding to the region in which the plurality of client devices are positioned;

when the plurality of client devices are not positioned within the same region, convert the at least one of the sound signal and the video signal using parameter values; and output the converted at least one of the sound signal and the video signal.

2. The information processing apparatus according to claim 1, wherein the circuitry is further configured to convert the sound signal using parameter values defining a mixing ratio of a multi-channel sound signal.

3. The information processing apparatus according to claim 1, wherein the circuitry is further configured to convert the video signal using parameter values defining an enlargement ratio of at least one of video and text included in the video signal.

4. The information processing apparatus according to claim 1, wherein the circuitry is further configured to detect the region in which each of the plurality of the client devices is positioned as a time variable on a basis of the signal output from the plurality of client devices over time.

5. The information processing apparatus according to claim 1, wherein the circuitry is further configured to maintain currently used parameter values when the detected region of each of the plurality of client devices remains unchanged.

6. A system comprising:

the information processing apparatus according to claim 1; and each of the plurality of the client devices including a receiver configured to receive the at least one of the sound signal and the video signal from the information processing apparatus and a reproducing circuit configured to reproduce the received at least one of the sound signal and the video signal.

7. The information processing apparatus according to claim 1, wherein the circuitry is configured to detect the region in which each of the plurality of client devices is positioned based on the measurement result which comprises a radio field strength and delay characteristics of the signal output from each of the plurality of client devices.

8. The information processing apparatus according to claim 1, wherein the target area is formed oppositely to a display surface of a display device.

9. An information processing method for an information processing apparatus that outputs at least one of a sound signal and a video signal as an output signal, the method comprising:

receiving a measurement result from one or more wireless nodes that measure a signal output from each of a plurality of client devices;

detecting a region in which each of the plurality of client devices is positioned within a target area divided into a plurality of regions, on a basis of the received measurement result, wherein each of the plurality of regions has a set of corresponding parameter values for controlling the at least one of the sound signal and the video signal;

determining whether all of the plurality of client devices are positioned within a same region;

when the plurality of client devices are positioned within the same region converting the at least one of the sound signal and the video signal using the parameter values corresponding to the region in which the plurality of client devices are positioned:

when the plurality of client devices are not positioned within the same region, converting the at least one of the sound signal and the video signal using parameter values: and outputting the converted at least one of the sound signal and the video signal.

10. A non-transitory computer-readable medium having a program recorded thereon, the program configured to perform a method when executed on a computer, the method comprising:

receiving a measurement result from one or more wireless nodes that measure a signal output from each of a plurality of client devices;

detecting a region in which each of the plurality of client devices is positioned within a target area divided into a plurality of regions, on a basis of the received measurement result, wherein each of the plurality of regions has a set of corresponding parameter values for controlling at least one of a sound signal and a video signal;

determining whether all of the plurality of client devices are positioned within a same region:

when the plurality of client devices are positioned within the same region converting the at least one of the sound signal and the video signal using the parameter values corresponding to the region in which the plurality of client devices are positioned;

when the plurality of client devices are not positioned within the same region, converting the at least one of the sound signal and the video signal using parameter values; and outputting the converted at least one of the sound signal and the video signal.

11. An information processing apparatus comprising:

circuitry configured to receive a measurement result from one or more wireless nodes that measure a signal output from each of a plurality of client devices;

detect a region in which each of the plurality of client devices is positioned within a target area divided into a plurality of regions, on a basis of the received measurement result, wherein each of the plurality of regions has a set of corresponding parameter values for controlling at least one of a sound signal and a video signal;

determine whether all of the plurality of client devices are positioned within a same region;

when the plurality of client devices are positioned within the same region convert the at least one of the sound signal and the video signal using the parameter values corresponding to the region in which the plurality of client devices are positioned; and when the plurality of client devices are not positioned within the same region, convert the at least one of the sound signal and the video signal using parameter values.

* * * * *